US006637241B1

(12) United States Patent
Wang

(10) Patent No.: US 6,637,241 B1
(45) Date of Patent: Oct. 28, 2003

(54) FABRIC TAKE-UP APPARATUS

(75) Inventor: Ping-Shih Wang, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 10/348,366

(22) Filed: Jan. 21, 2003

(51) Int. Cl.[7] ..... D04B 15/88
(52) U.S. Cl. ..... 66/151
(58) Field of Search ..... 66/147, 149 R, 66/150, 151, 152, 153; 242/520, 534, 535.5, 541, 544, 543, 547

(56) References Cited

U.S. PATENT DOCUMENTS 5,649,435 A 7/1997 Bryant ..... 66/8

*Primary Examiner*—Danny Worrell

(74) *Attorney, Agent, or Firm*—Albert Wai-Kit Chan; Mark Elkins

(57) ABSTRACT

An improved fabric take-up apparatus adopted for use on an elevated take-up apparatus with a large capacity includes a frame, a conveying mechanism located in the frame, a take-up mechanism located in the frame, at least one friction mechanism located in the frame between the conveying mechanism and the take-up mechanism, a balancing weight mechanism located on two sides of the frame, a speed changing mechanism located at a lower section of the frame and a stop mechanism located in the frame. The conveying mechanism transports the fabric to the take-up mechanism for rolling. The fabric is rolled until the diameter of the roll increases to contact the friction rod of the friction mechanism, then the friction rod aids the take-up mechanism to roll the fabric. Meanwhile, the friction mechanism is hauled by the balancing weight mechanism so that the friction rod firmly presses the rolling fabric. Thus the friction rod and the fabric may be prevented from being thrown away that might otherwise occur due to the centrifugal force generated by too fast rotation speed during the rolling process.

10 Claims, 11 Drawing Sheets

FABRIC TAKE-UP APPARATUS

FIELD OF THE INVENTION

The present invention relates to an improved fabric take-up apparatus adopted on an elevated take-up apparatus of a large capacity for preventing the fabric from being thrown away during fabric rolling and obtaining integrated and tubular fabric rolls.

BACKGROUND OF THE INVENTION

For the finished knitting fabrics from conventional knitting machines, a take-up apparatus generally is used to wind the fabrics in tubular rolls. The take-up apparatus may be grouped in two types: one type can wind the fabric in a roll at a diameter about 20 inches. Because of its small capacity, it is not widely used nowadays. Another type can form fabric rolls at a diameter up to about 46 inches. As it has a greater capacity, it is widely used now.

When the elevated take-up apparatus with a greater capacity is in use for rolling the fabric and has reached a diameter of 25 inches, the weight occurred to the rolling bar increases. As the conventional take-up apparatus use belts to transmit power, idle running is prone to occur between the transmission wheel of the rolling bar and the belt. As a result, the rolling bar cannot rotate smoothly to take up the remaining fabric, and machine malfunction frequently occurs.

To remedy the aforesaid problems, some producers use chains to replace the conventional belts. For instance, U.S. Pat. No. 5,649,435 discloses a circular knitting machine with replaceable knitting head that has a chain to perform initial transmission for rolling the fabric. The fabric is rolled by a frictional approach. When the fabric roll reaches the diameter of 25 inches (the fabric wound on the rolling bar becomes heavy), the transmission through the chain can be maintained without idle running, thus the fabric may be rolled continuously. In that patent, when the fabric is rolled and gradually increases, the rolling bar is moved upwards gradually along a guiding channel until the diameter of the fabric roll reaches about 46 inches. However, when the rotating speed of the rolling bar increases, the centrifugal force also increases. Moreover, the fabric is pliable and the rolling bar tends to occur wobbling and results in uneven fabric rolling (not uniform friction), and the fabric is prone to be thrown away. Furthermore, during fabric rolling, if the fabric has knitting floats, the floats will be destroyed (due to the heavy weight of the fabric). Thus such type of elevated fabric rolling apparatus with a large capacity is not suitable for rolling high quality fabrics, and can only be used for rolling general industrial fabrics.

SUMMARY OF THE INVENTION

The primary object of the invention is to resolve the aforesaid disadvantages. The elevated fabric take-up apparatus of a large capacity of the invention aims to prevent the fabric from being thrown away during rolling process and avoid the fabric from being damaged (due to the fabric is not being pressed on the friction bar) so that it can be used to roll any type of fabrics without restrictions.

In order to achieve the foregoing object, the fabric take-up apparatus of the invention includes a frame, a conveying mechanism located in the frame, a take-up mechanism located in the frame, at least one friction mechanism located in the frame between the conveying mechanism and the take-up mechanism, a balancing weight mechanism located on two sides of the frame, a speed changing mechanism located at a lower section of the frame and a stop mechanism located in the frame. The conveying mechanism transports the fabric to the take-up mechanism for rolling. The fabric is rolled until the diameter of the roll increases to contact the friction bar of the friction mechanism, then the friction bar aids the take-up mechanism to roll the fabric. Meanwhile, the friction mechanism is towed by the balancing weight mechanism. Thus the friction bar and the rolling fabric can be prevented from being thrown away during the rolling process.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
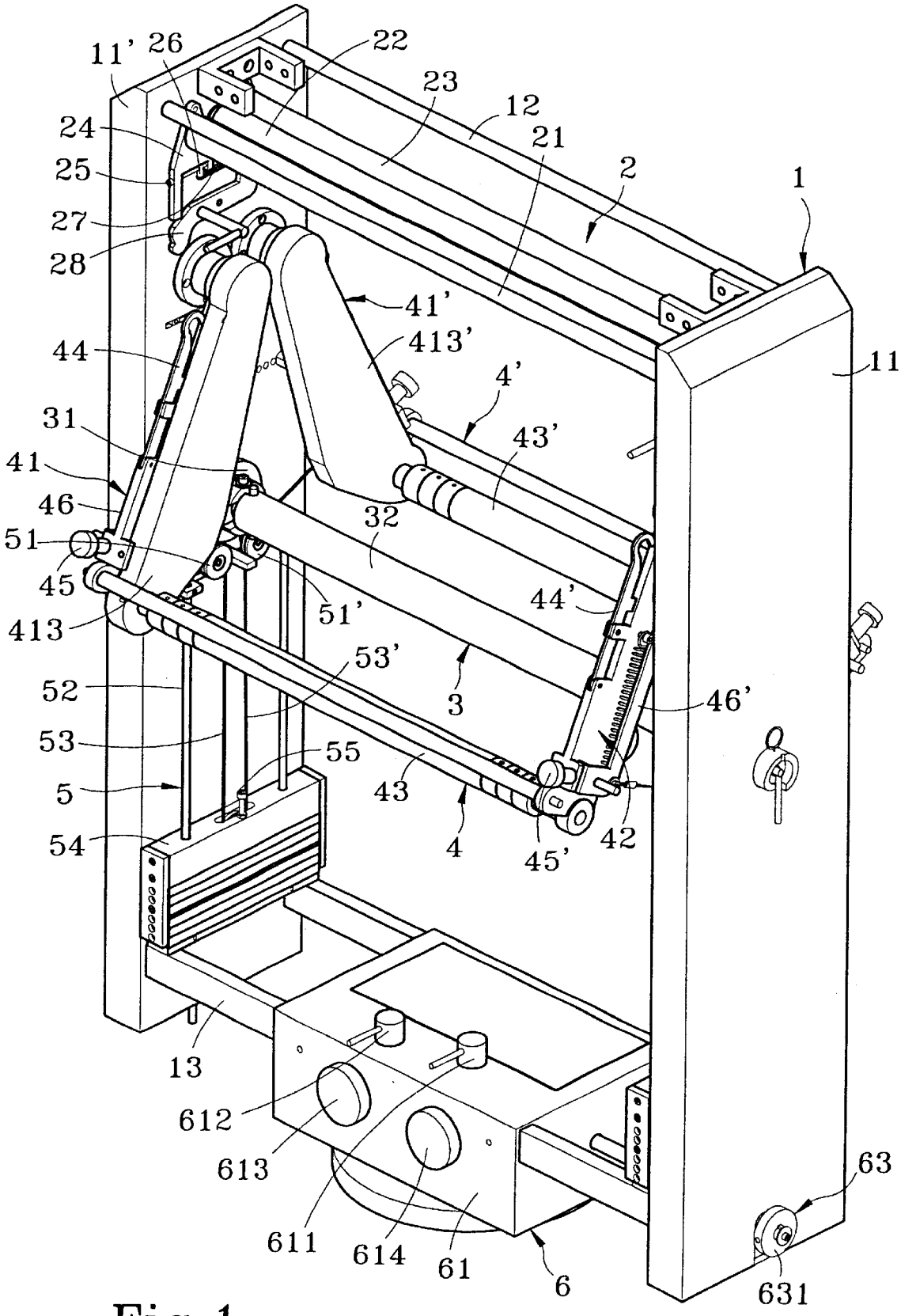
FIG. 1 is a perspective view of the fabric take-up apparatus of the invention.
Figure 2:
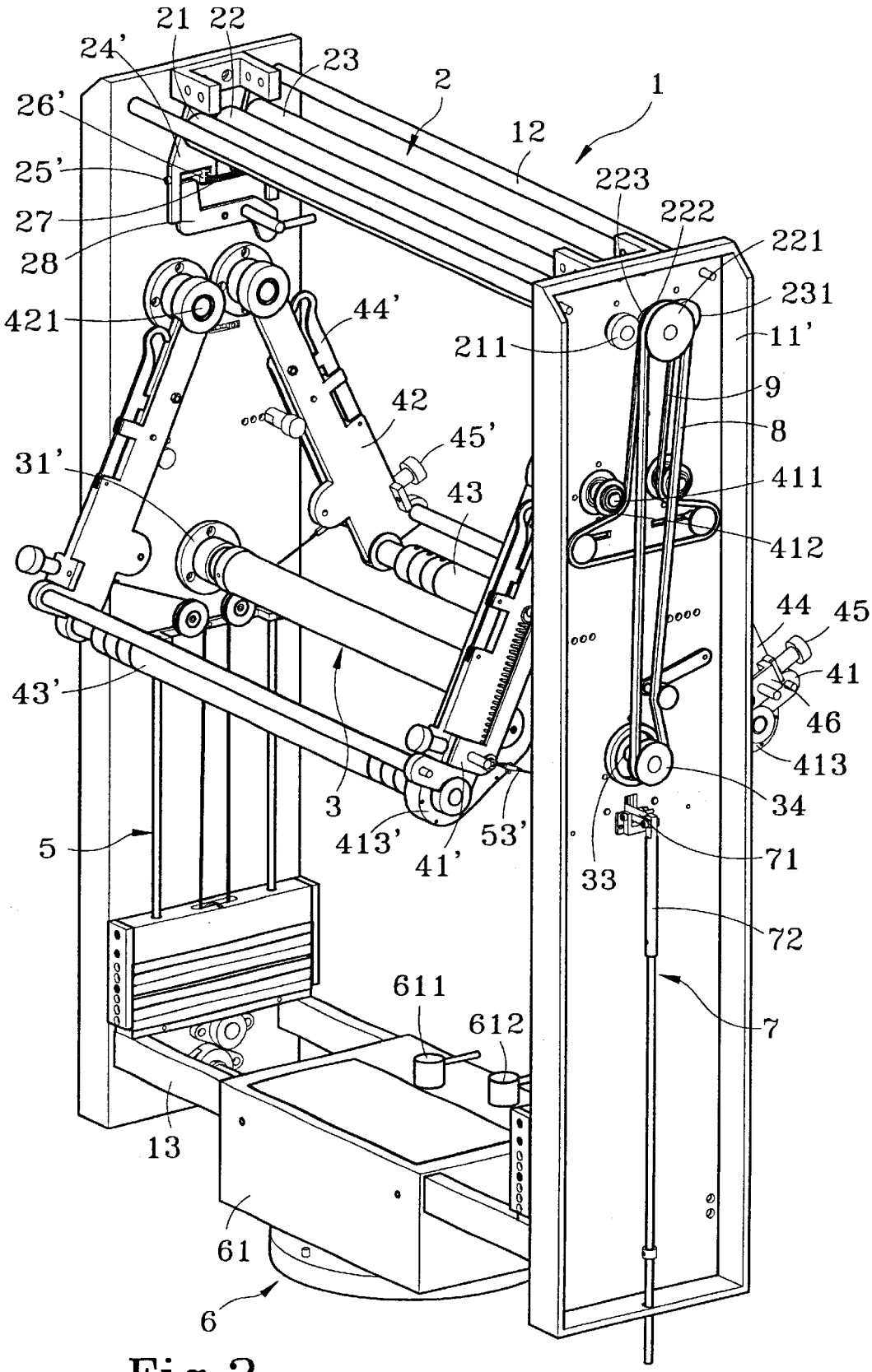
FIG. 2 is another perspective view of the invention according to FIG. 1.
Figure 3A:
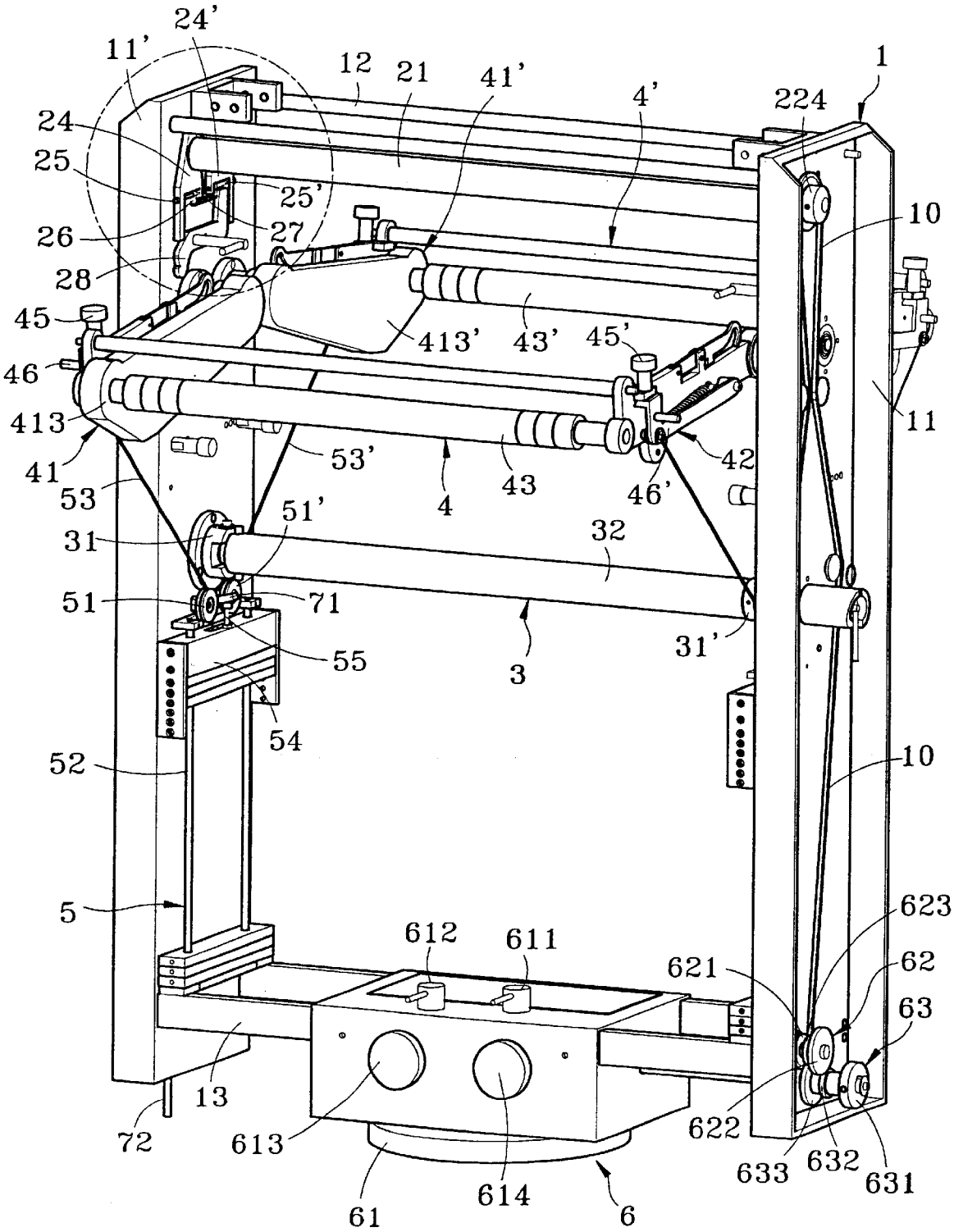
FIG. 3A is yet another perspective view of the invention according to FIG. 1.
Figure 3B:
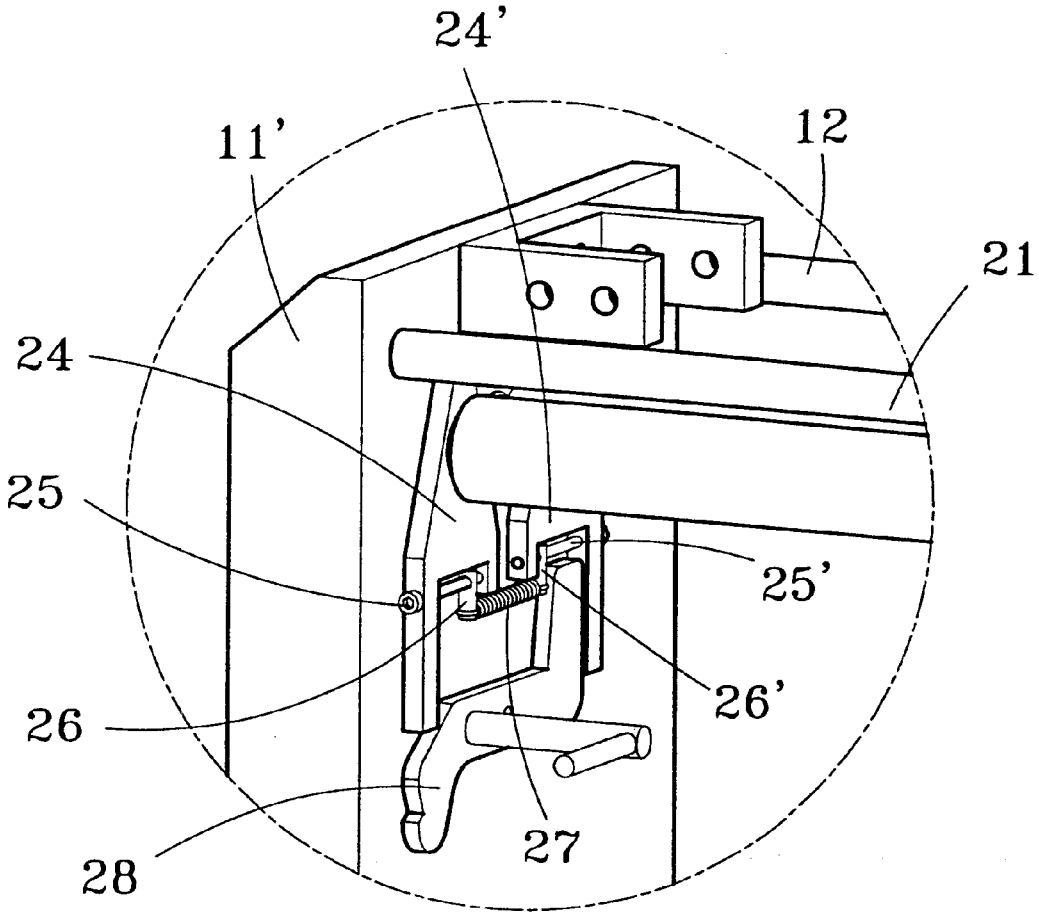
FIG. 3B is a fragmentary enlarged view of the invention according to FIG. 3A.
Figure 4A:
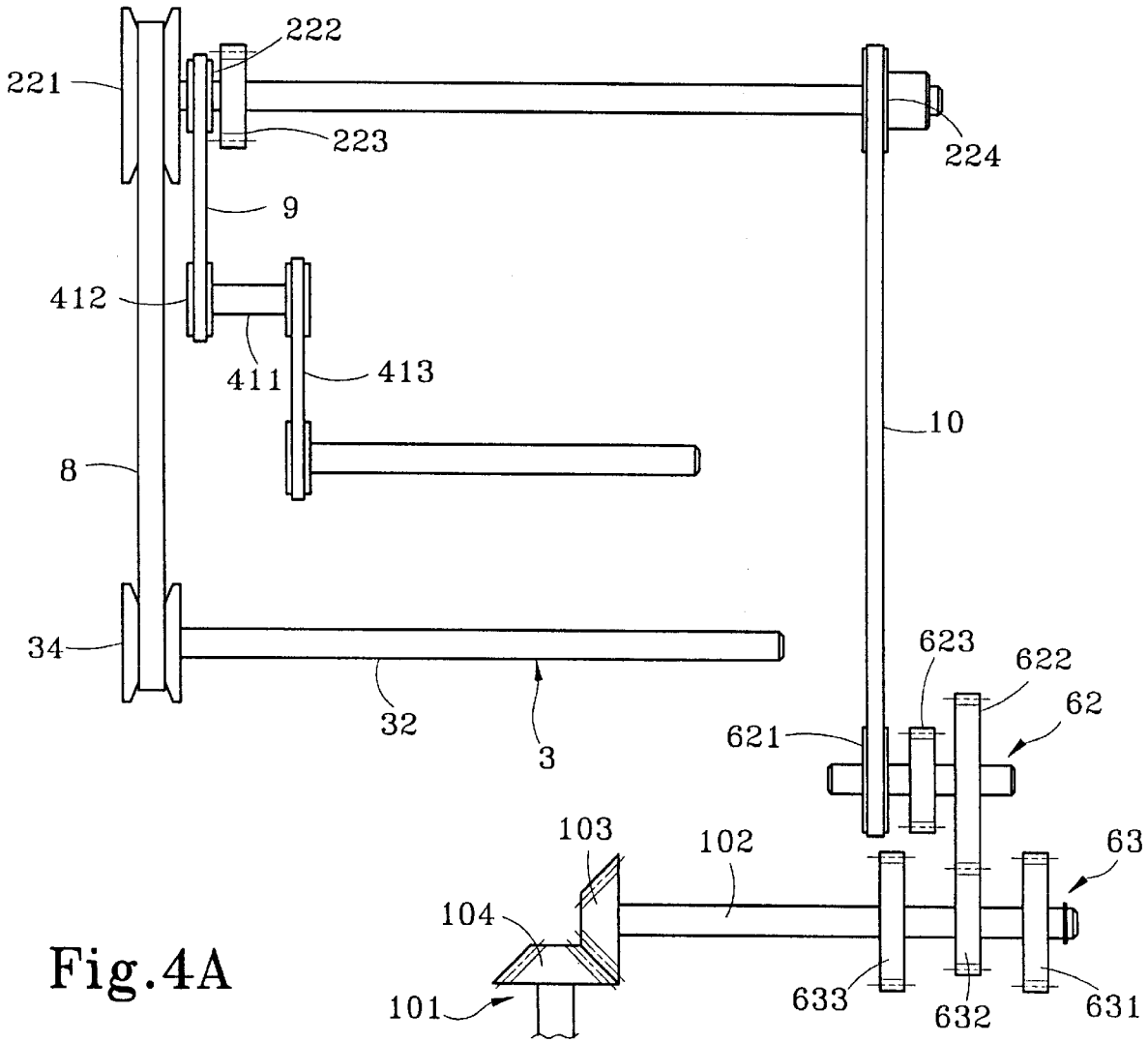
FIGS. 4A, 4B and 4C are schematic side views of the invention in various operating conditions.
Figure 4B:
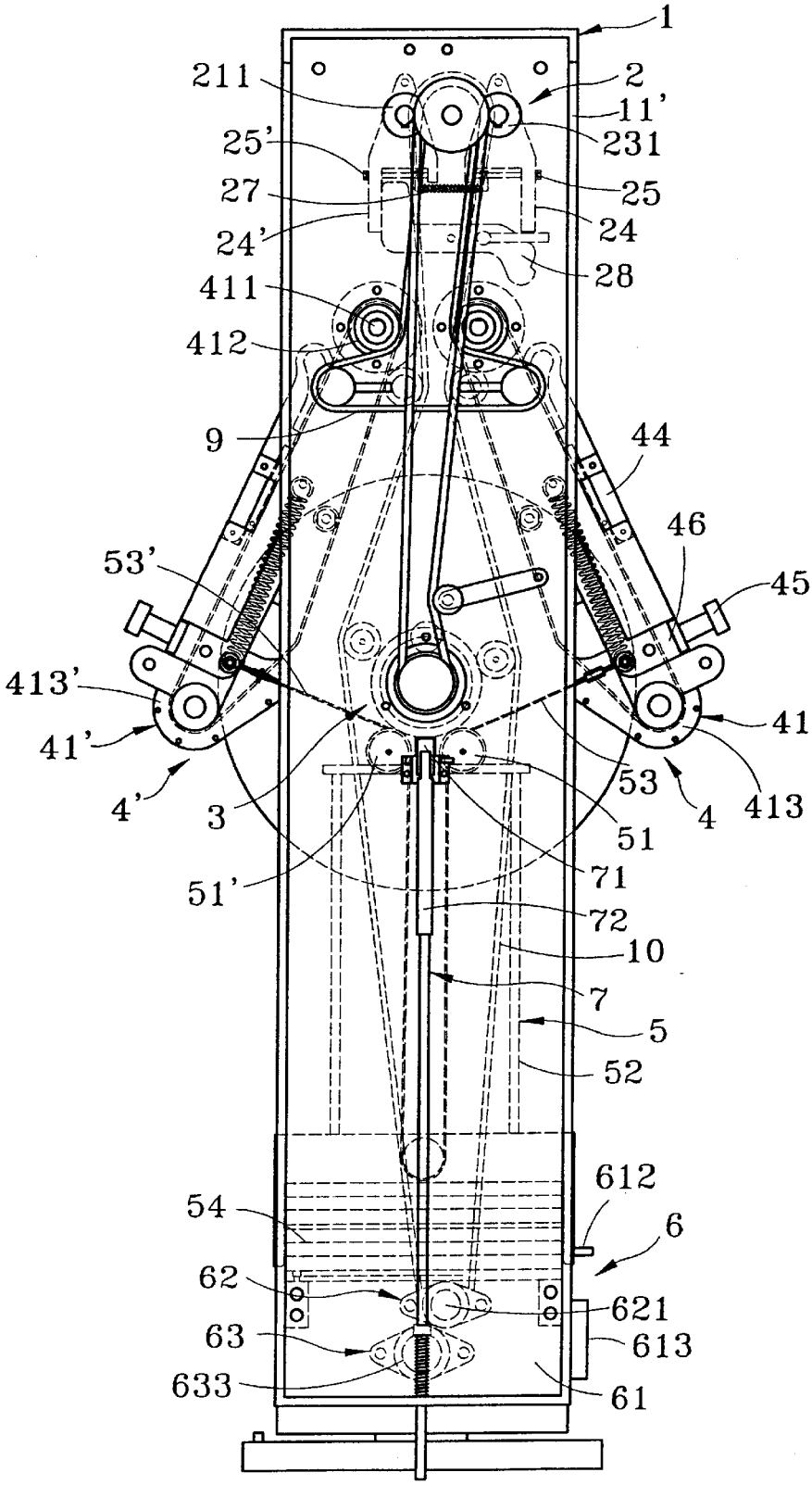
Figure 4C:
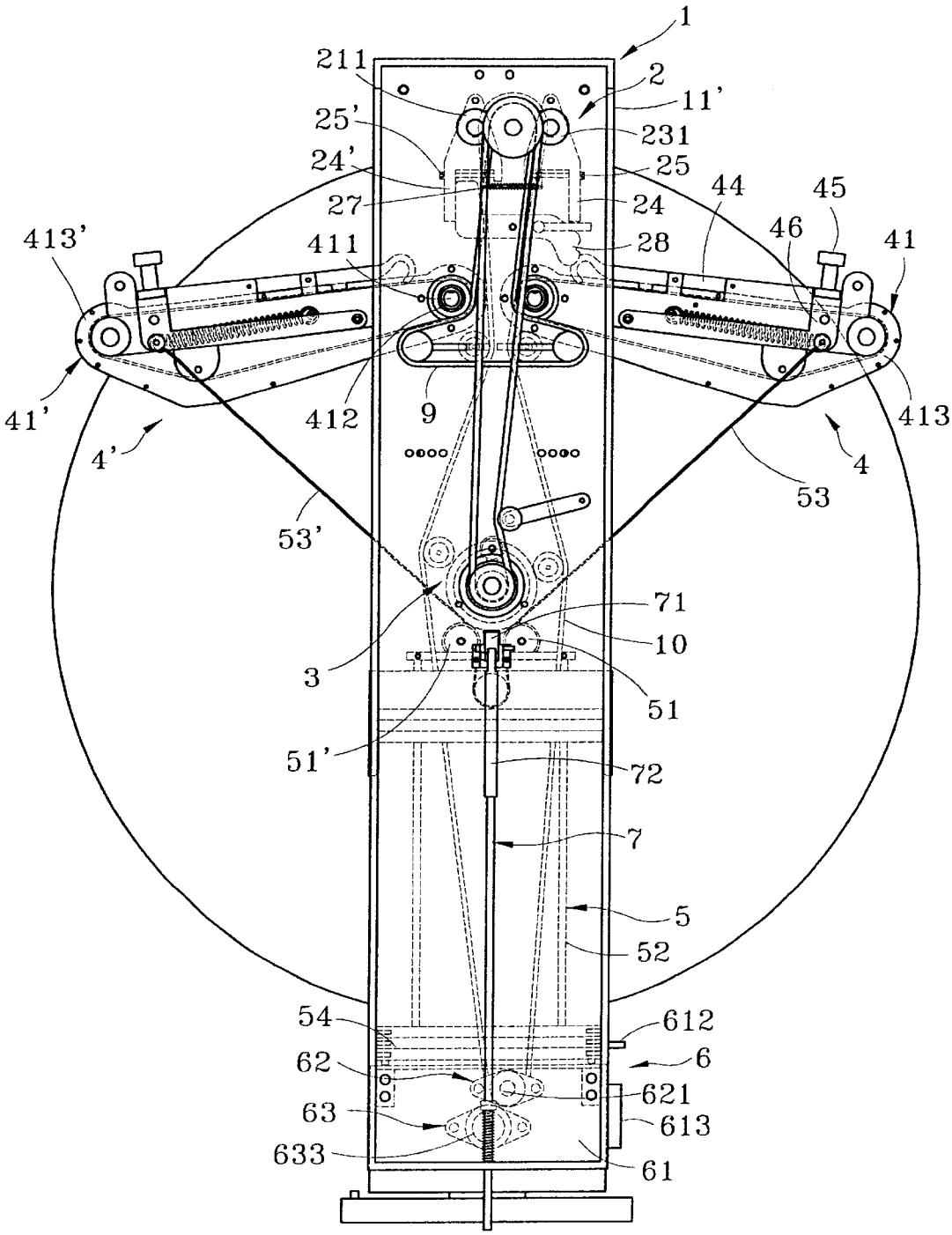
Figure 5A:
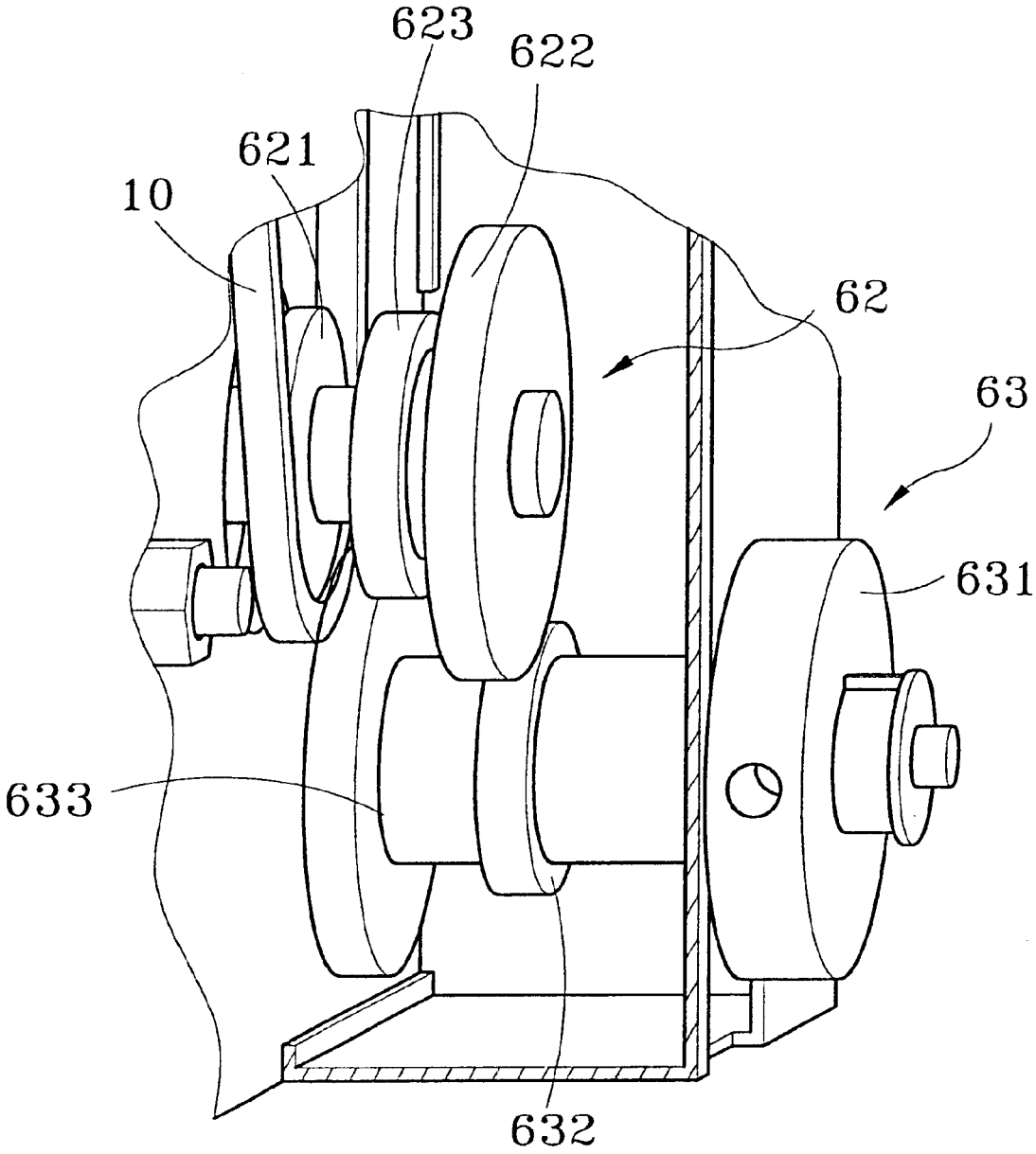
FIGS. 5A and 5B are schematic views of the invention for adjusting the fabric tension and manually adjusting the fabric roll.
Figure 5B:
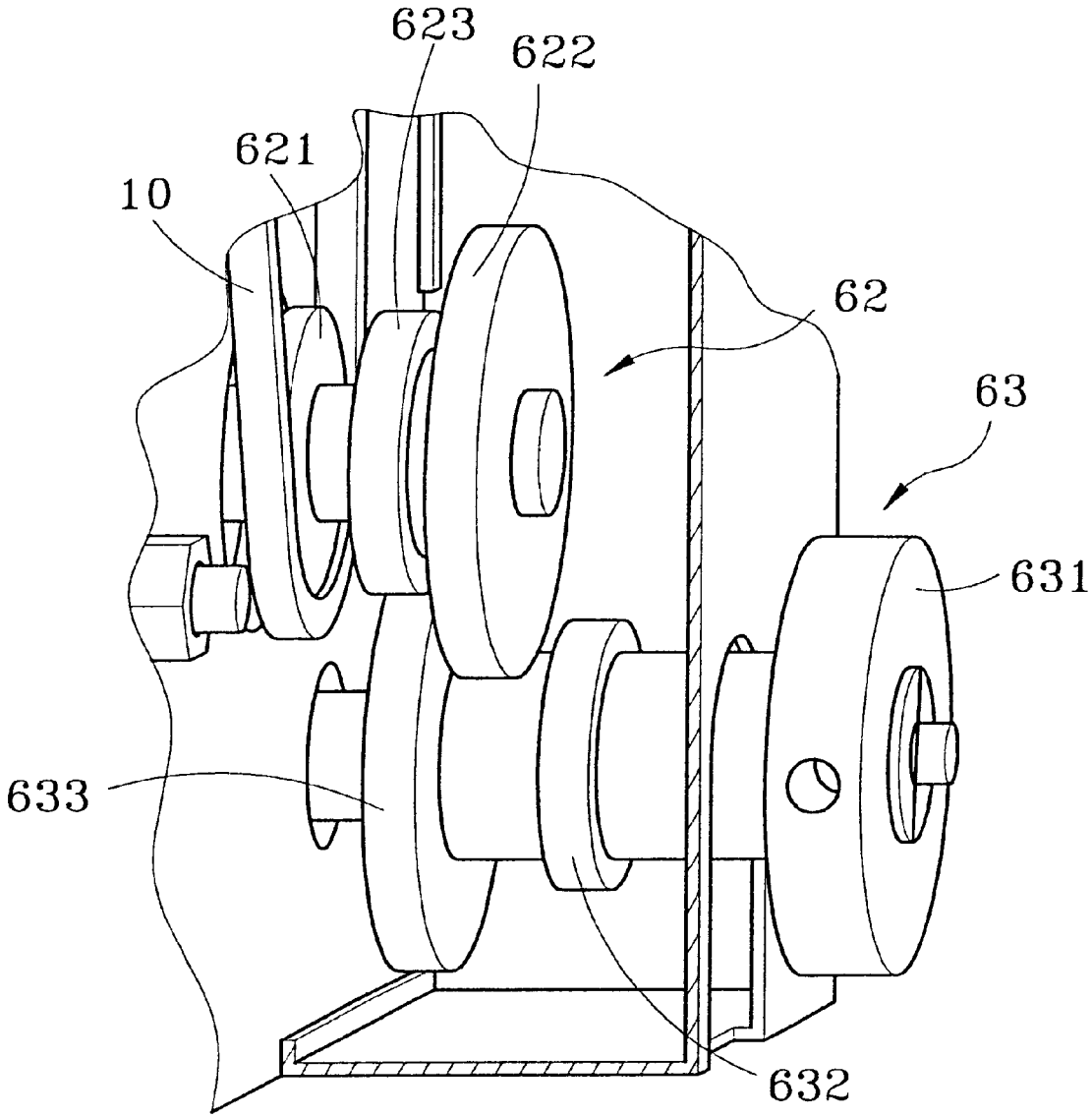

Referring to FIGS. 1, 2, 3A and 3B, the fabric take-up apparatus of the invention is an elevated device for taking up a greater amount of fabrics. The apparatus consists of:

- a frame 1 which has two side boxes 11 and 11', and a plurality of support rods 12 and 13 located between the side boxes 11 and 11';
- a conveying mechanism 2 located on an upper portion of the frame 1 including a first rolling bar 21, a second rolling bar 22 and a third rolling bar 23. The rolling bars 21, 22 and 23 have two ends running through respectively the side boxes 11 and 11'. The one end of the second rolling bar 22 that runs through the side box 11' is coupled with a first transmission wheel 221, a second transmission wheel 222 and a driven wheel 223. The one end of the first rolling bar 21 and the third rolling bar 23 that run through the side box 11' are coupled respectively with a passive wheel 211 and 231 to mesh the driven wheel 223. When the first transmission wheel 221 of the second rolling bar 22 is driven by a transmission member (chain) 8 and rotates, the first and third rolling bars 21 and 23 also are driven to rotate. Moreover, the first and third rolling bars 21 and 23, before running through the side boxes 11 and 11', are coupled respectively with an anchor member 24 and 24'. The anchor member 24 and 24' have respectively an adjusting member 25 and 25' formed by a screw bar. The adjusting member 25 and 25' are coupled respectively with a movable block 26 and 26'. The movable blocks 26 and 26' are interposed by an elastic element 27. Turning the two adjusting member 25 and 25', the displacement of the two movable blocks 26 and 26' may be controlled. And the elastic element 27 is extended or compressed. Thereby the interval between the first and third rolling bars 21 and 23, and the second rolling bar 22 may be adjusted. In addition, a control member 28 is located below the two anchor members 24 and 24'. The control member 28 has one end extending below the anchor member 24'. When the control member 28 is operative, the anchor member 24' drives the third rolling bar 23 to mesh the second rolling bar 22;

a take-up mechanism 3 including a pair of symmetrical axles 31 and 31' and a rolling shaft 32 pivotally coupling with the two axles 31 and 31'. The take-up mechanism 3 further has a transmission shaft 33 extending into the sides box 11' to couple with a third transmission wheel 34. The third transmission wheel 34 and the first transmission wheel 221 are coupled with the same transmission member 8. When the first transmission wheel 221 is driven, the rotation is transmitted to the third transmission wheel 34. Consequently the rolling shaft 32 of the take-up mechanism 3 is driven to rotate to take up the fabric;

Two sets of friction mechanisms 4 and 4' corresponding to each other and being pivotally located between the conveying mechanism 2 and the take-up mechanism 3. Each friction mechanism 4 (only one set is taken for explanation) has two operating arms 41 and 42 and a friction rod 43. The operating arms 41 and 42 have respectively an axle 411 and 421. The axle 411 runs through the side box 11' and is coupled with a fourth transmission wheel (chain sprocket) 412. The fourth transmission wheel 412 and the second transmission wheel 222 are coupled to a same transmission member 9. Thus when the first transmission wheel 221 of the second rolling bar 22 rotates, the second transmission wheel 222 also rotates synchronously. Meanwhile, the transmission member 9 drives the axle 411 which in turn drives a transmission set 413 coupled on the operating arm 41. When the transmission set 413 is driven by the axle 411, it drives the friction rod 43 to rotate. When the fabric roll on the take-up mechanism 3 exceeds 25 inches in diameter, the weight on the rolling shaft 32 increases. As a result, the first transmission wheel 221 cannot drive the third transmission wheel 34 to rotate normally. Then the friction rod 43 aids the take-up mechanism 3 to perform fabric take-up operation. In addition, the two operating arms 41 and 42 have respectively a hook 44 and 44'. When the fabric rolling on the take-up apparatus has finished and the fabric to be removed, or the take-up apparatus stops operation, the hooks 44 and 44' may be clipped on the support rods 12 to prevent the friction mechanism 4 from pressing the rolled fabric. Such a construction can facilitate removing of the fabric or repairs and maintenance, or installation;

a balancing weight mechanism 5 (only one set is taken for explanation) including one set of pulleys 51 and 51', a guiding rail 52, two towing members 53 and 53', a balance weight set 54 and a bucking strut 55. The towing member 53 winds around the pulleys 51 and 51' and has one end fastening to an outer bar 46 of the operating arm 41 and another end fastening to the balance weight set 54. When the fabric rolled on the take-up mechanism 3 increases, it pushes the two friction mechanisms 4 and 4' outwards. The two operating arms 41 and 41' of the friction mechanisms 4 and 4' haul the balance weight set 54 along the guiding rail 52. As the balance weight set 54 has a selected weight, the friction rods 43 and 43' of the friction mechanisms 4 and 4' press firmly the fabric rolled on the take-up mechanism 3. Therefore the rolled fabric may be prevented from being thrown away. In the mean time, the friction rods also aid the take-up mechanism 3 to perform fabric rolling. The balance weight set 54 consists of a plurality of metal pieces. Thus the weight of balance weight set 54 may be adjusted by adding or removing a suitable number of the metal pieces. The weight is determined by the rotation speed of the take-up mechanism 3. If the take-up mechanism 3 has a fast rotation speed and the operating arms 41 and 41' escape from the fabric surface, it indicates that the centrifugal force is greater than the balance weight set 54, then an additional weight must be added to the balance weight set 54. Such an arrangement helps to achieve tidy surface for the entire fabric and enables the take-up apparatus 3 to steadily take up the finished knitting fabric of the knitting machine;

a speed changing mechanism 6 including a control box 61, a first variable speed transmission set 62 and a second variable speed transmission set 63 (also referring to FIGS. 5A and 5B). The control box 61 has clutch handles 611 and 612 for controlling the fabric tension or manual rolling of the fabric, and speed stage adjusting knobs 613 and 614 for adjusting the fabric take-up speed. The first variable speed transmission set 62 has a fifth transmission wheel 621 and driven wheels 622 and 623 of different sizes. The fifth transmission wheel 621 is coupled with a transmission member 10 which has one end coupled on a sixth transmission wheel 224 mounted on another end of the second rolling bar 22. The second variable speed transmission set 63 has an external adjusting knob 631 located outside the side box 11 and driven wheels 632 and 633 of different sizes located in the side box 11. When the control box 61 is in use for control, the driven wheel 622 of the first variable speed transmission set 62 may mesh the driven wheel 632 of the second variable speed transmission set 63 to form a first stage adjustment. When the driven wheel 623 of the first variable speed transmission set 62 meshes the driven wheel 633 of the second variable speed transmission set 63, it forms a second stage adjustment. By means of such arrangements, the fabric tension or manual rolling of the fabric may be adjusted; and a stop mechanism 7 including an actuating bar 71 and a linkage bar 72. The actuating bar 71 is located between the two pulleys 51 and 51' and is extended into the side box 11'. Moreover, the actuating bar 71 has one end pivotally connected to the linkage bar 72. The linkage bar 72 extends outside the bottom of the side box 11' to connect to a sensor (not shown in the drawings). When the take-up mechanism 3 rolls the fabric to a selected size and the bucking strut 55 of the balancing weight set 54 presses the actuating bar 71, the actuating bar 71 moves the linkage bar 72 to trigger the sensor. The sensor detects the signal and orders the take-up apparatus to stop operation so that operator may remove the rolled fabric from the take-up mechanism 3. By means of the elements set forth above, an elevated take-up apparatus with a greater capacity can be constructed.

Referring to FIGS. 4A through 6, when employing the take-up apparatus to roll the fabric, the operator first threads the front section of the fabric through the rolling bars 21, 22 and 23, and manually winds the fabric on the rolling shaft 32 of the take-up mechanism 3.

When the take-up apparatus operates, the stationary shaft 101 and the bevel gear 104 remain stationary. When the take-up apparatus is driven to rotate, another bevel gear 103 located on one end of the transmission shaft 102 rolls over the bevel gear 104 on the stationary shaft 101 to drive the second variable speed transmission set 63 which in turn drives the first variable speed transmission set 62 to rotate. The first variable speed transmission set 62 drives the second rolling bar 22 to rotate through the transmission member (chain) 10. When the second rolling bar 22 rotates, the first and second transmission wheels 221 and 222, and the driven wheel 223 located on another end of the second rolling bar 22 are driven to rotate concurrently. Meanwhile, the first transmission wheel 221 drives the third transmission wheel 34 to rotate through the transmission member 8. As a result, the rolling shaft 32 of the take-up mechanism 3 also rotates to wind and take up the fabric. In addition, the second transmission wheel 222 drives the axles 411 and the fourth transmission wheel 412 through the transmission member 9, and the transmission sets 413 and 413' also drive the friction rods 43 and 43' to rotate.

When the fabric rolled on the rolling shaft 32 gradually increases, the outer perimeter of the fabric gradually contacts the friction rods 43 and 43' of the friction mechanism 4 and 4'. When the diameter of the fabric roll reaches 25 inches (the fabric roll with a diameter smaller than 25 inches is driven by the belts. The fabric roll with a diameter greater than 25 inches is driven by the friction rods 43 and 43'), the weight on the rolling shaft 32 increases, the friction rods 43 and 43' of the friction mechanisms 4 and 4' aid the rolling shaft 32 to roll the fabric to reduce the load of the rolling shaft 32.

As the fabric wound on the rolling shaft 32 increases even more, the friction mechanisms 4 and 4' will be pushed outwards to haul the balancing weight mechanism 5. The balancing weight set 54 is gradually hoisted upwards. Because of the balancing weight mechanism 5, the friction rods 43 and 43' of the friction mechanisms 4 and 4' may press firmly on the rolled fabric, and the friction mechanisms 4 and 4' and the fabric may also be prevented from being thrown away due to too fast rotation. Thus the fabric may be rolled neatly, and malfunction of the take-up apparatus can be reduced, or the fabric can be prevented from being ruptured or damaged.

When the fabric rolled on the rolling shaft 32 of the take-up mechanism 3 reaches a diameter of about 46 inches, the balancing weight set 54 of the balancing weight mechanism 5 is hauled to the highest end, and the bucking strut 55 of the balancing weight set 54 presses the actuating bar 71 which in turn moves the linkage bar 72 to trigger the sensor. The sensor detects the signal and immediately orders the take-up apparatus to stop operation so that the operator can remove the rolled fabric from the take-up apparatus.

Adjustment of the fabric tension during the take-up process, or taking-up the fabric manually can be accomplished through the control box 61. Through the clutch handles 611 and 612 of the control box 61, the driven wheel 622 of the first variable speed transmission set 62 may be meshed with the driven wheel 632 of the second variable speed transmission set 63 to form a first stage adjustment. Moreover, the driven wheel 623 of the first variable speed transmission set 62 may be meshed with the driven wheel 633 of the second variable speed transmission set 63 to form a second stage adjustment. Thus fabric tension or manual control of fabric rolling may be controlled as desired. In addition, by adjusting the speed stage adjusting knobs 613 and 614 in cooperative with the clutch handles 611 and 612, at least 120 different types of stage adjustments may be achieved to facilitate rolling of different types of fabrics.

Figure 6:
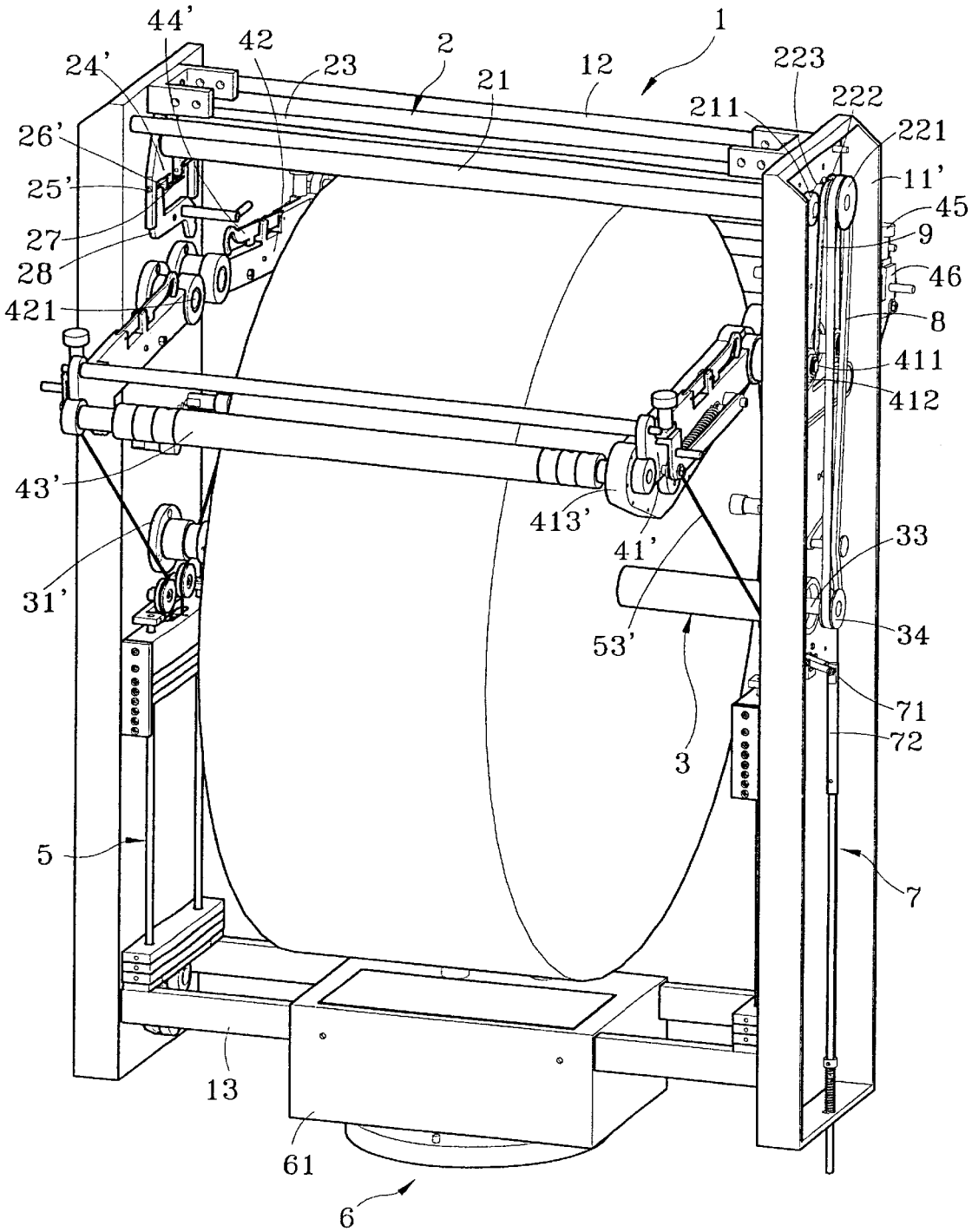
FIG. 6 is a schematic perspective view of the invention with a finished fabric roll.
Figure 7:
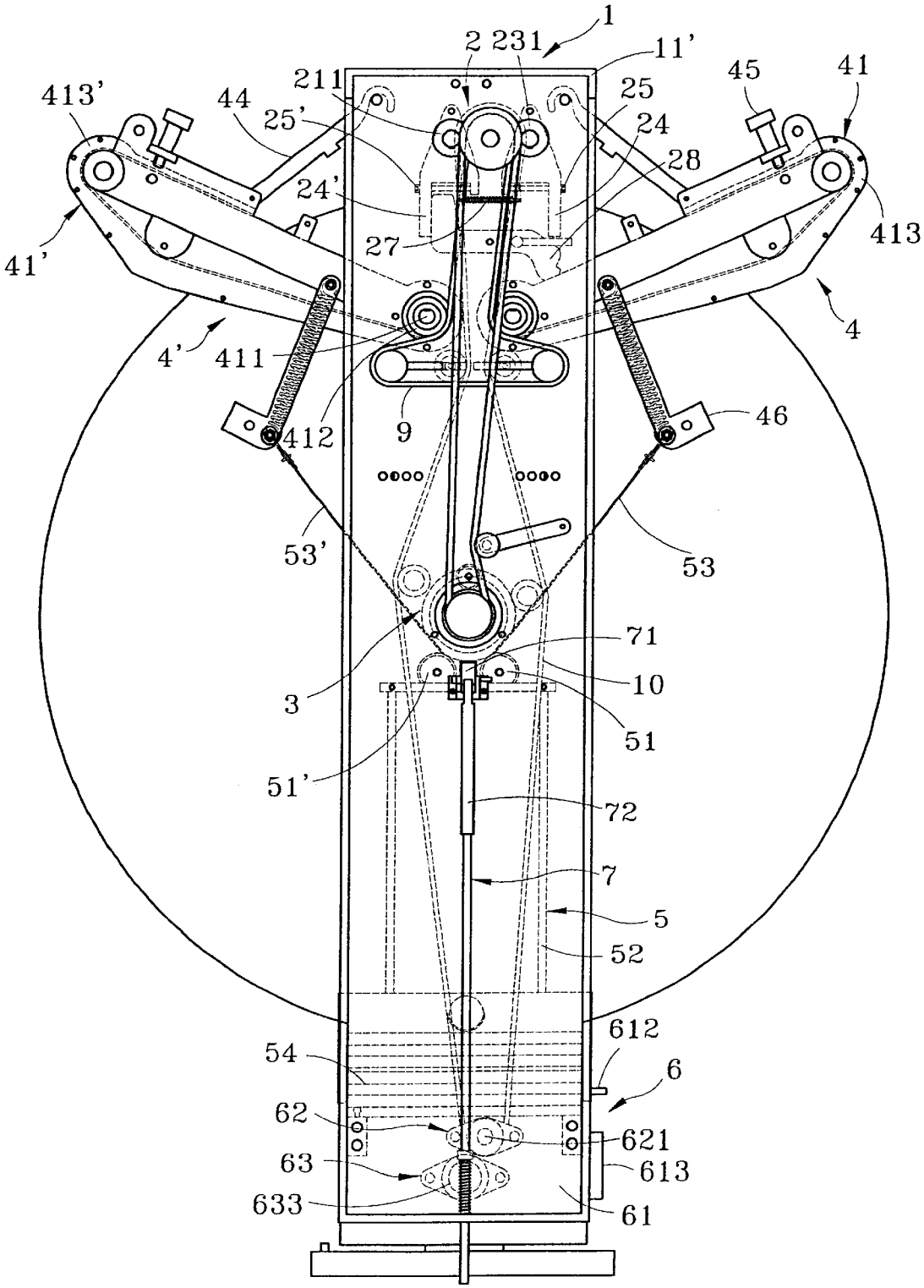
FIG. 7 is a schematic side view of the invention with a finished fabric roll.

Referring to FIGS. 6 and 7, when the fabric take-up process is finished and the rolled fabric to be removed, or the take-up apparatus is inoperative, the rotary knobs 45 and 45' on the operating arms 41 and 42 may be turned loose to separate the operating arms 41 and 42 from the outer bars 46 and 46'. Then the hooks 44 and 44' may be hung on the support rod 12 to prevent the friction mechanism 4 from pressing the rolled fabric. Thus the rolled fabric may be removed easily, or repair or installation activities may be performed conveniently.

What is claimed is:

1. A fabric take-up apparatus adopted for use on an elevated take-up apparatus of a large capacity to take-up a finished fabric from a knitting machine comprising a frame, a take-up mechanism located in the frame, a speed changing mechanism located at a lower section of the frame and a stop mechanism located in the frame, wherein:

the frame has a conveying mechanism, at least one friction mechanism and at least one balancing weight mechanism; the conveying mechanism including a first rolling bar, a second rolling bar and a third rolling bar; the friction mechanism including two operating arms and a friction rod; the balancing weight mechanism including a towing member for hauling the friction rod;

wherein the conveying mechanism transports the fabric to the take-up mechanism for rolling until the diameter of the fabric roll increases to contact the friction rod of the friction mechanism, then friction rod aids the take-up mechanism to roll the fabric, and the balancing weight mechanism hauls the friction mechanism to firmly press the rolled fabric and prevent the friction rod and the fabric from being thrown away.

2. The fabric take-up apparatus of claim 1, wherein the second rolling rod has one end running through side boxes of the frame to couple with a first transmission wheel, a second transmission wheel and a driven wheel, the first transmission wheel being coupled with a transmission member.

3. The fabric take-up apparatus of claim 2, wherein the transmission member is selectively a chain or a belt.

4. The fabric take-up apparatus of claim 1, wherein the take-up mechanism further has a transmission shaft extending into the side boxes to couple with a third transmission wheel, the third transmission wheel and the first transmission wheel being coupled with a same transmission member.

5. The fabric take-up apparatus of claim 1, wherein the operating arms have respectively an axle, the axle running through the side box and being coupled with a fourth transmission wheel, the fourth transmission wheel and the second transmission wheel being coupled with another transmission member.

6. The fabric take-up apparatus of claim 5, wherein the axle drives a transmission set located on the operating arm.

7. The fabric take-up apparatus of claim 6, wherein the transmission set is driven by the axle to drive the friction rod to rotate.

8. The fabric take-up apparatus of claim 1, wherein the balancing weight mechanism includes one set of pulleys, a guiding rail, two towing members, a balance weight set and a bucking strut.

9. The fabric take-up apparatus of claim 8, wherein the towing members wind around the pulleys and have one end fastening to the operating arm and another end fastening to the balance weight set.

10. The fabric take-up apparatus of claim 8, wherein the balance weight set includes a plurality of metal pieces which have varying weights determined by the fabric rolling speed of the take-up mechanism.

* * * * *